US008371235B1

(12) United States Patent
Early

(10) Patent No.: US 8,371,235 B1
(45) Date of Patent: Feb. 12, 2013

(54) VACUUM AND GRAVITY DISCHARGE HOPPER CAR GATE

(75) Inventor: Stephen R. Early, Olathe, KS (US)

(73) Assignee: Aero Transportation Products, Inc., Independence, MO (US)

( * ) Notice: Subject to any disclaimer, the term of this patent is extended or adjusted under 35 U.S.C. 154(b) by 178 days.

(21) Appl. No.: 12/973,386

(22) Filed: Dec. 20, 2010

(51) Int. Cl.
*B61D 3/00* (2006.01)

(52) U.S. Cl. ..... 105/247; 105/282.1

(58) Field of Classification Search ..... 105/280, 105/282.1–282.3, 247, 248, 253, 286, 288, 105/305
See application file for complete search history.

(56) References Cited

U.S. PATENT DOCUMENTS 3,110,270 A * 11/1963 Ingram ..... 105/253
3,133,509 A * 5/1964 Farmer ..... 105/253
3,138,116 A * 6/1964 Dorey ..... 105/253
3,194,420 A 7/1965 Kemp et al.
3,255,553 A * 6/1966 Dorey ..... 105/282.1
3,255,714 A * 6/1966 Dorey ..... 105/253
3,344,748 A * 10/1967 Dorey ..... 105/282.1
3,348,501 A * 10/1967 Stevens et al. ..... 105/248
3,450,064 A * 6/1969 Floehr et al. ..... 105/282.1
3,577,680 A * 5/1971 Nagy ..... 49/358
3,581,673 A * 6/1971 Danielson ..... 105/253
3,611,947 A * 10/1971 Nagy ..... 105/253
3,631,812 A * 1/1972 Winslow, Jr. ..... 105/240
3,709,152 A * 1/1973 Gutridge ..... 105/253
3,778,114 A 12/1973 Carney, Jr. et al.
3,780,672 A * 12/1973 Fuller ..... 105/253
3,831,803 A * 8/1974 Hutchison et al. ..... 220/378
3,837,294 A * 9/1974 Fossett ..... 105/253
4,009,906 A * 3/1977 Sweet et al. ..... 298/27
4,114,785 A 9/1978 Dugge
4,151,935 A 5/1979 Dugge
4,163,583 A 8/1979 Hammonds
4,236,458 A * 12/1980 Varda ..... 105/310.2
4,360,295 A 11/1982 Anderson
4,382,725 A 5/1983 Dugge
4,574,989 A * 3/1986 Pole ..... 222/486
5,000,358 A 3/1991 Dugge
5,232,315 A 8/1993 Dugge
5,236,287 A 8/1993 Dugge et al.
6,123,030 A 9/2000 Dohr et al.
6,263,803 B1 * 7/2001 Dohr et al. ..... 105/282.3
6,286,437 B1 * 9/2001 Lucas ..... 105/282.3
6,363,863 B1 * 4/2002 Dohr ..... 105/247
6,412,421 B2 * 7/2002 Dohr et al. ..... 105/282.2
6,412,422 B2 * 7/2002 Dohr et al. ..... 105/282.3
6,571,718 B2 * 6/2003 Lucas ..... 105/282.3
6,736,072 B2 * 5/2004 Degelman et al. ..... 105/258
6,932,433 B2 * 8/2005 Heider et al. ..... 298/27
7,124,693 B2 * 10/2006 Lucas ..... 105/282.2
7,171,907 B2 * 2/2007 Early ..... 105/247
7,367,271 B2 * 5/2008 Early ..... 105/282.2
7,806,057 B2 * 10/2010 Early ..... 105/253
7,814,842 B2 * 10/2010 Early ..... 105/282.3
2002/0073883 A1 * 6/2002 Lucas ..... 105/247
(Continued)

*Primary Examiner* — Jason C Smith
(74) *Attorney, Agent, or Firm* — Stinson Morrison Hecker LLP

(57) ABSTRACT

A hopper car gate having a frame, a moveable door supported by the frame, and a set of walls coupled with the frame. The walls have a lower edge partially spaced above the door, and are positioned to define a vacuum chamber between the walls and the frame. The vacuum chamber is in fluid communication with a vacuum opening formed in the frame. A vacuum adapter configured for mounting on a hopper car gate. The adapter has first and second sets of walls with a vacuum chamber between the sets of walls. The vacuum chamber is in fluid communication with a vacuum opening in the first set of walls.

25 Claims, 20 Drawing Sheets

U.S. PATENT DOCUMENTS

2003/0192452 A1* 10/2003 Lucas ..... 105/247
2005/0081741 A1* 4/2005 Fortuna ..... 105/280
2005/0166788 A1* 8/2005 Early ..... 105/247
2005/0263031 A1* 12/2005 Early ..... 105/247
2006/0042499 A1* 3/2006 Fortuna ..... 105/282.1
2006/0249047 A1* 11/2006 Fortuna ..... 105/282.1
2009/0007813 A1* 1/2009 Early ..... 105/253
2010/0107924 A1* 5/2010 Early ..... 105/282.3

* cited by examiner

VACUUM AND GRAVITY DISCHARGE HOPPER CAR GATE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is directed toward a hopper car gate or a vacuum adapter for a hopper car gate and, more particularly, to a vacuum and gravity discharge hopper car gate or a vacuum discharge adapter for a gravity discharge hopper car gate.

2. Description of Related Art

Conventional hopper car gates that are designed for both gravity and vacuum discharge typically have a frame that supports two vertically spaced doors. The doors have separate opening and closing mechanisms. For gravity discharge, both of the doors are moved into an open position. For vacuum discharge, the top door is moved at least partially to an open position and the bottom door is left in a closed position. A vacuum draws cargo from the volume between the top and bottom doors. While these gates are generally suitable for their intended purpose, they are relatively heavy, expensive, and complex.

BRIEF SUMMARY OF THE INVENTION

A hopper car gate according to one embodiment of the present invention includes a first set of walls including opposed side walls coupled with opposed end walls. A vacuum opening is formed in one of the side or end walls. The first set of walls has top and bottom openings. At least one rail, and preferably two or more rails, extends between and is coupled with the side or end walls adjacent the bottom opening. A door is supported on the rail and is moveable between a closed position that blocks the bottom opening and an open position that allows cargo to exit through the bottom opening. A second set of walls includes opposed side walls coupled with opposed end walls. The second set of walls has an upper edge and a lower edge that is at least partially spaced above the door when the door is in its closed position to present a gap between the lower edge and the door. The second set of walls is coupled with the first set of walls to present a vacuum chamber positioned between the first and second sets of walls. The vacuum chamber is in fluid communication with the vacuum opening.

A vacuum adapter according to another embodiment of the present invention is configured for mounting on a hopper car gate. The hopper car gate has a frame presenting a top opening, a bottom opening, and an upper surface surrounding the top opening. A door is supported by the frame and is moveable between a closed position in which it blocks the bottom opening and an open position in which it allows cargo to exit through the bottom opening for discharging cargo from the hopper car. The vacuum adapter has a flange that is configured for mounting to the upper surface of the gate. The adapter also has first and second sets of walls. The first set of walls has an upper edge and a lower edge that is coupled with the flange. A vacuum opening is formed in the first set of walls. The second set of walls has an upper edge that is coupled with the upper edge of the first set of walls and a lower edge that is at least partially spaced above the door when the door is in its closed position to present a gap between the lower edge and the door. The second set of walls is positioned to define a vacuum chamber between the first and second sets of walls and the frame. The vacuum chamber is in fluid communication with the vacuum opening.

A hopper car gate according to another embodiment of the present invention has a frame defining a discharge opening. A door is supported by the frame and is moveable between a closed position in which it blocks the discharge opening and an open position in which it allows cargo to exit through the discharge opening. A set of walls has an upper edge coupled with an upper edge of the frame and a lower edge that is at least partially spaced above the door when the door is in its closed position to present a gap between the lower edge and the door. The set of walls is positioned to define a vacuum chamber between the set of walls and the frame. The vacuum chamber is in fluid communication with a vacuum opening formed in the frame.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
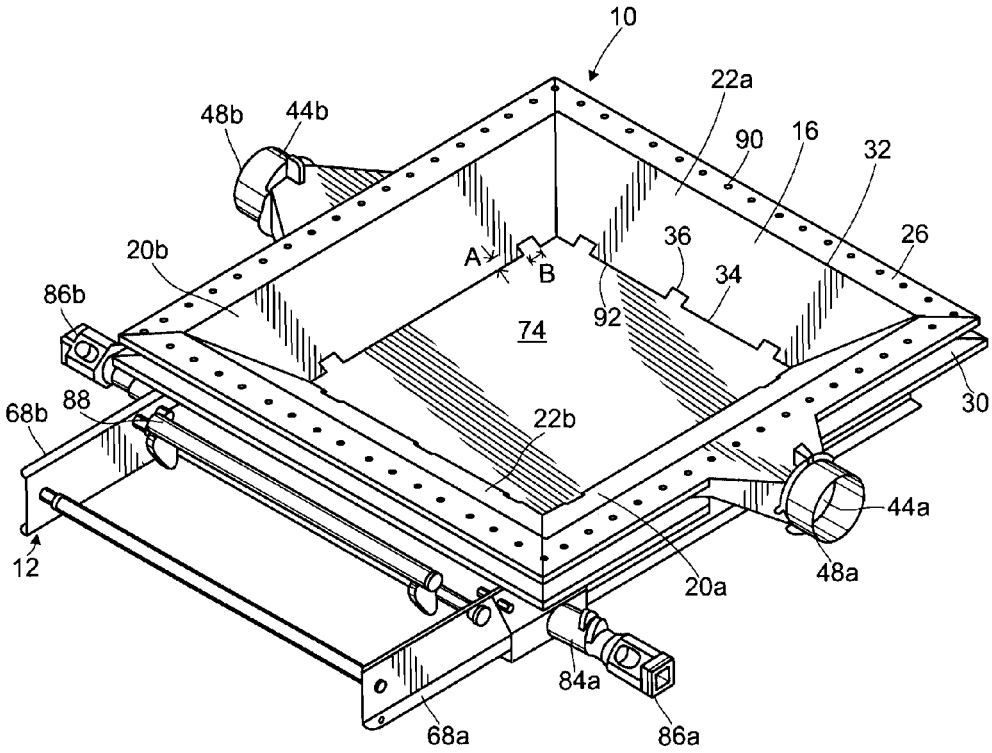
FIG. 1 is a perspective view of a vacuum adapter according to one embodiment of the present invention joined to a hopper car gate frame.
Figure 2:
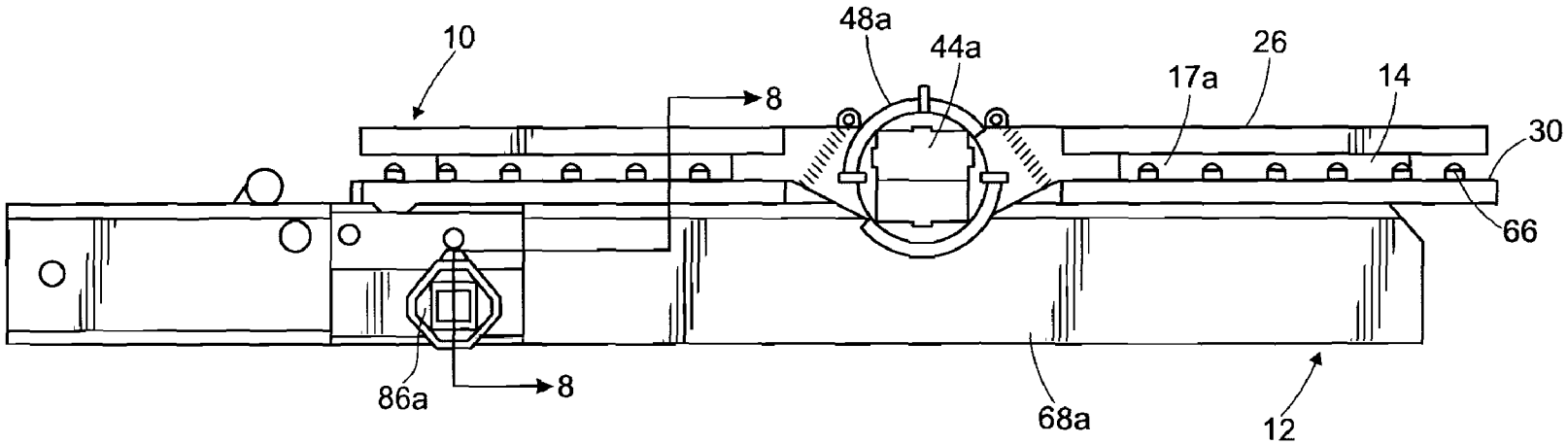
FIG. 2 is a side elevational view of the adapter and gate shown in FIG. 1.
Figure 3:
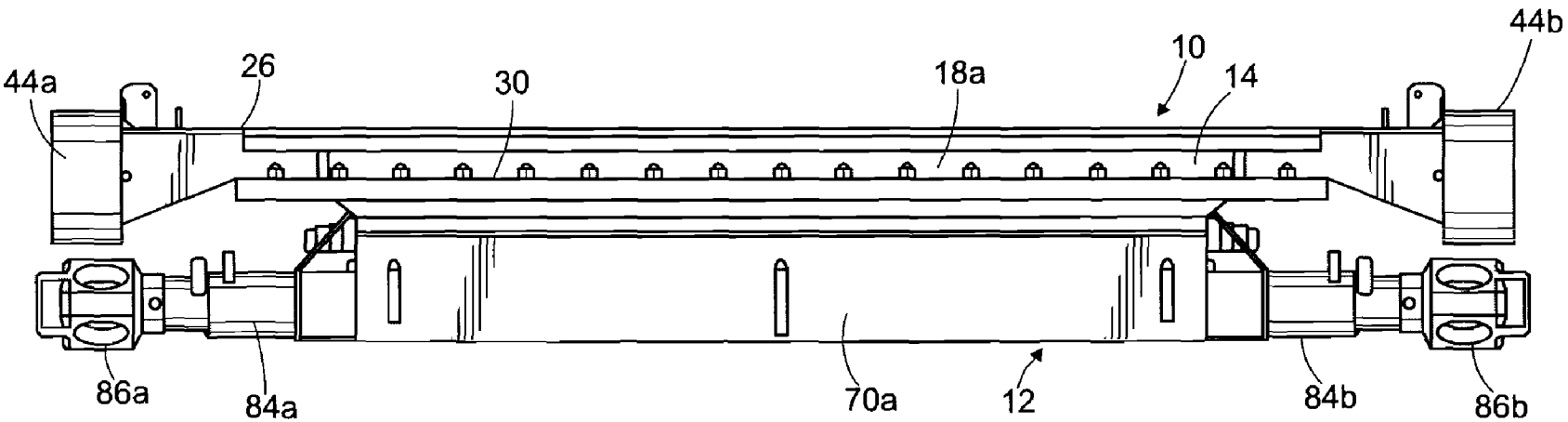
FIG. 3 is a front elevational view of the adapter and gate shown in FIG. 1.
Figure 4:
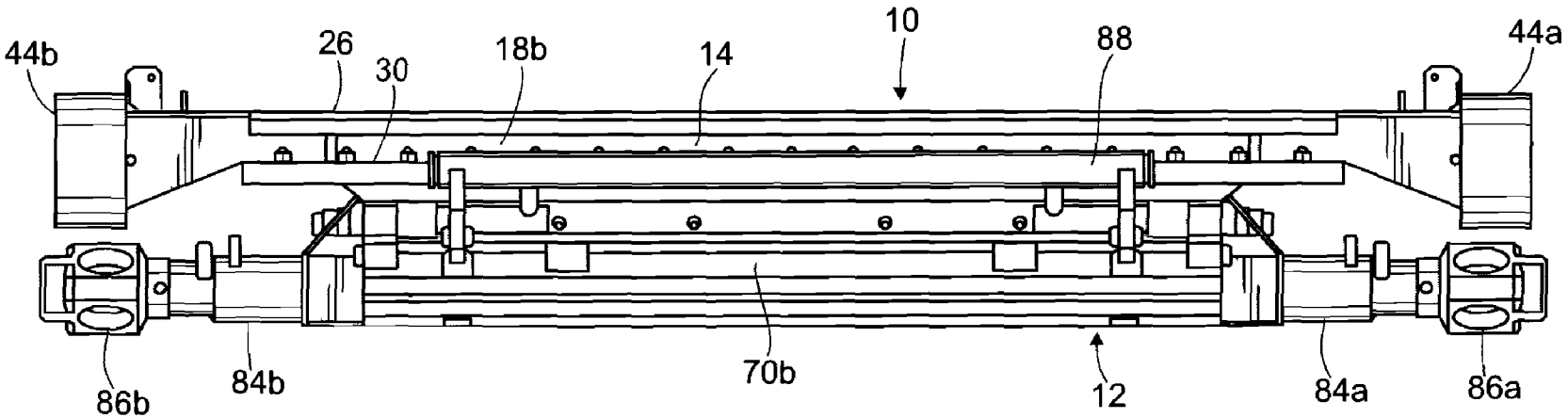
FIG. 4 is a rear elevational view of the adapter and gate shown in FIG. 1.
Figure 5:
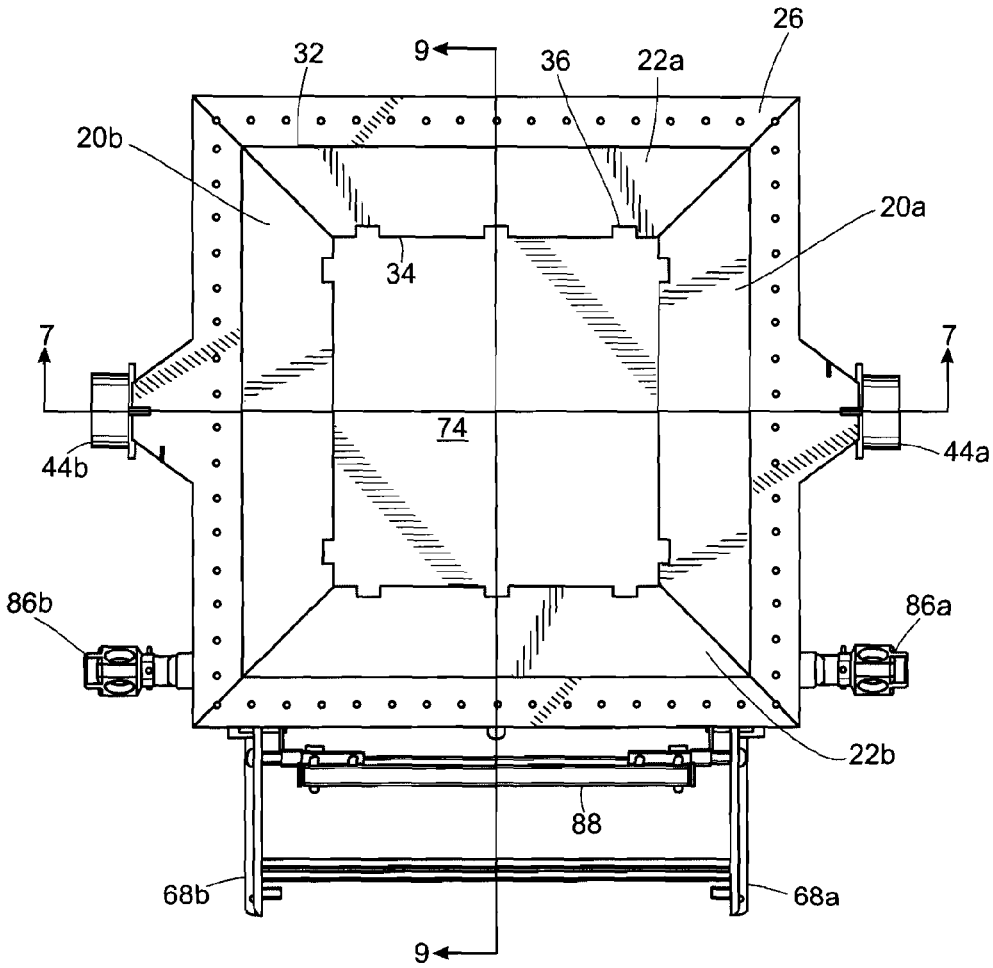
FIG. 5 is a top plan view of the adapter and gate shown in FIG. 1.
Figure 7:
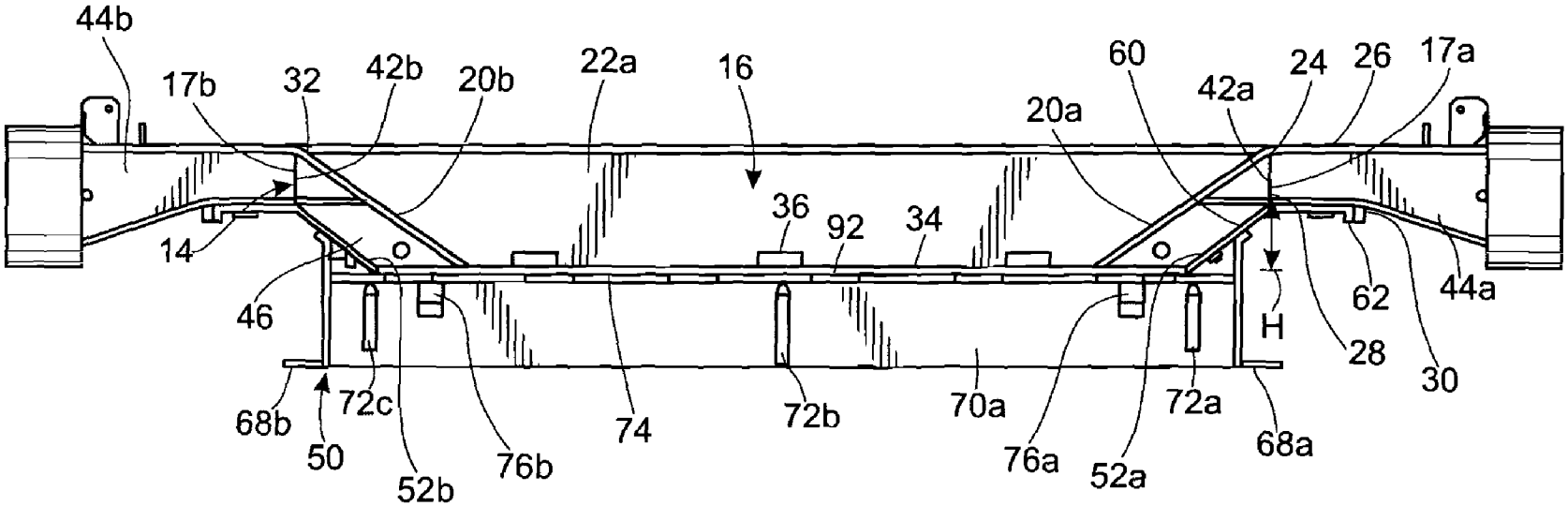
FIG. 7 is a cross-sectional view taken through the line 7-7 of FIG. 5.
Figure 8:
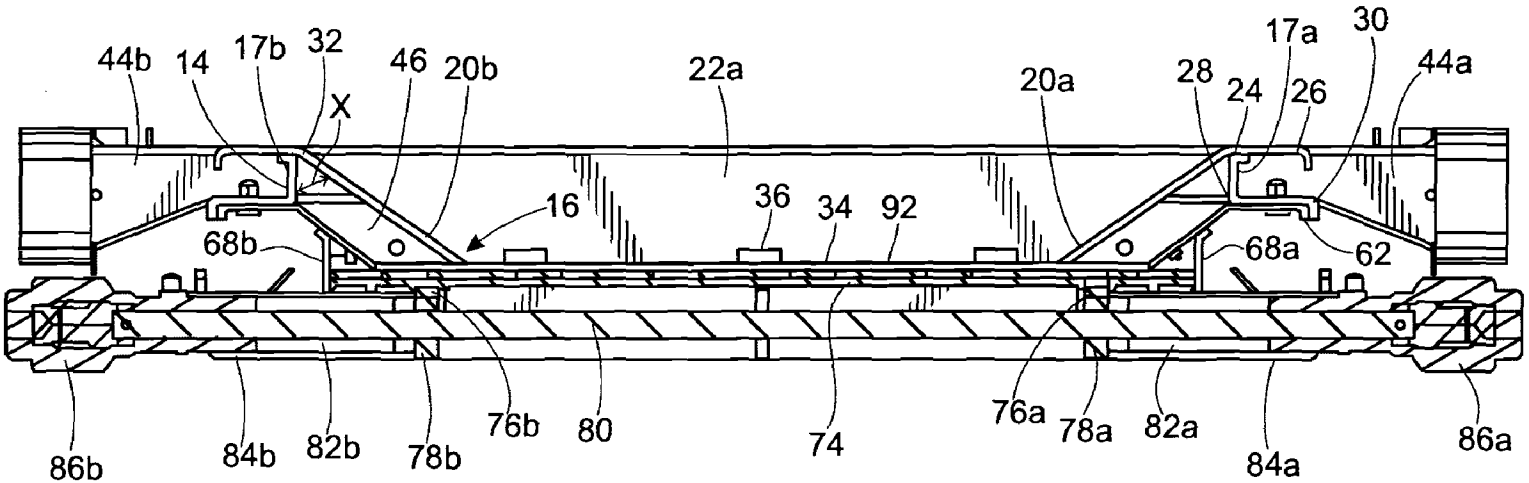
FIG. 8 is a cross-sectional view taken through the line 8-8 of FIG. 2.
Figure 9:
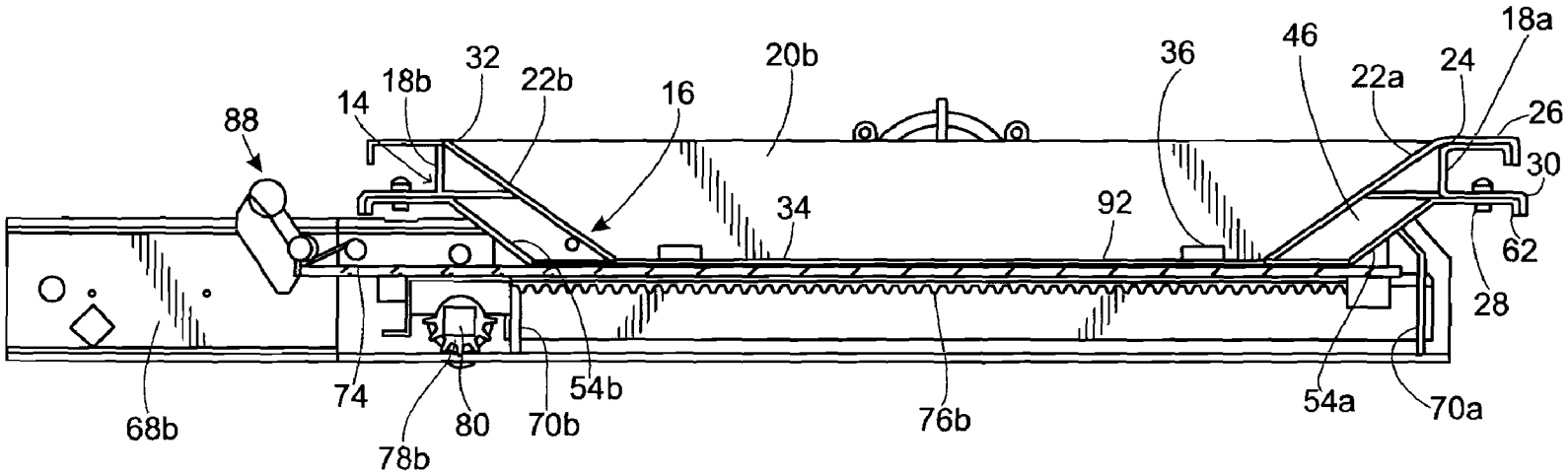
FIG. 9 is a cross-sectional view taken through the line 9-9 of FIG. 5.
Figure 10:
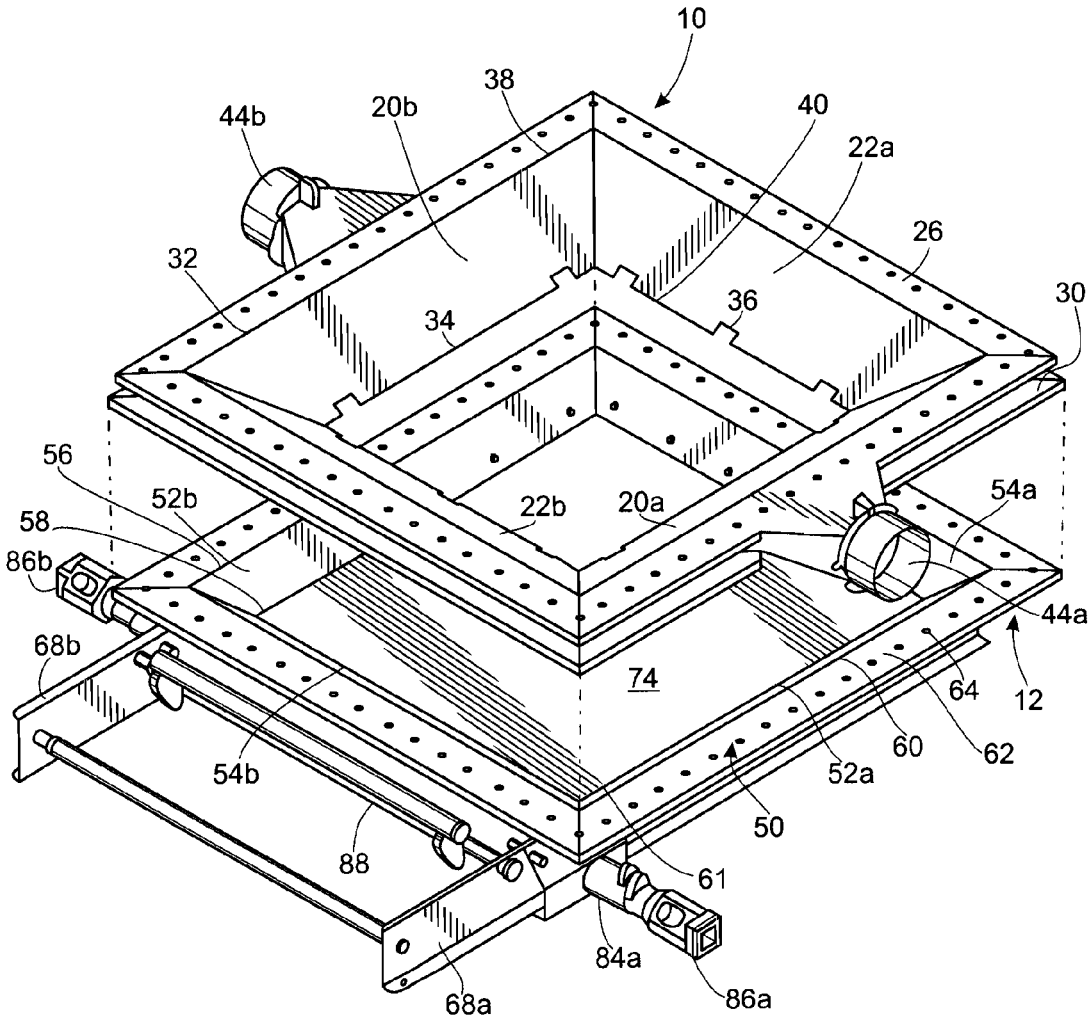
FIG. 10 is a partially exploded view of the adapter and gate shown in FIG. 1.

A vacuum adapter according to one embodiment of the present invention is shown generally as 10 in FIG. 1. As shown in FIG. 10, the vacuum adapter 10 joins to a gravity discharge hopper car gate 12. The vacuum adapter 10 includes a first set of walls 14, shown in FIGS. 2 and 3, and a second set of walls 16, shown in FIG. 1. The first set of walls 14 includes opposed side walls 17*a* and 17*b* (shown in FIG. 7) each joined with opposed end walls 18*a* and 18*b* (shown in FIG. 9). Referring to FIG. 1, the second set of walls 16 includes opposed side walls 20*a* and 20*b* each joined with opposed end walls 22*a* and 22*b*. Referring to FIG. 7, the first set of walls 14 has an upper edge 24 that is joined with an upper flange 26 and a lower edge 28 that is joined with a lower flange 30. As shown in FIG. 1, the second set of walls 16 has an upper edge 32 that is joined with upper flange 26 and a lower edge 34. Referring to FIG. 8, there is an angle X between the first and second sets of walls 14 and 16. The angle X is preferably between approximately 30 to 60 degrees.

A plurality of notches 36 are formed in the lower edge 34 of walls 16. As shown in FIG. 1, there are three notches in each of end walls 22*a* and 22*b* and two notches in each of side walls 20*a* and 20*b*. It is within the scope of the invention for there to be more or less notches 36 than those shown in FIG. 1. The notches 36 preferably have a height A of between approximately 0.5 to 3 inches, and a width B of between approximately 1 to 4 inches. Referring to FIG. 10, the adapter 10 has a top opening 38 and a bottom opening 40 each defined by the walls 20*a-b* and 22*a-b*. The joined walls and flanges of adapter 10 may be integrally joined or joined by a process such as welding.

As shown in FIG. 7, vacuum openings 42*a* and 42*b* are formed in side walls 17*a* and 17*b*, respectively. Vacuum conduits 44*a* and 44*b* are joined with and extend outward from side walls 17*a* and 17*b*, respectively. Vacuum conduits 44*a* and 44*b* are in fluid communication with vacuum openings 42*a* and 42*b*, respectively. The first and second sets of walls 14 and 16 are spaced from each other to define a vacuum chamber 46 (FIGS. 7-9) that is in fluid communication with each of the vacuum openings 42*a* and 42*b*. As shown in FIG. 1, each of the vacuum conduits 44*a* and 44*b* has a circular outer flange 48*a* and 48*b*, respectively, that is configured to engage a vacuum system for drawing material from the vacuum chamber 46 through the vacuum openings 42*a* and 42*b* and vacuum conduits 44*a* and 44*b*.

The adapter 10 is joined with the frame 50 (FIG. 10) of hopper car gate 12. The hopper car gate frame 50 includes opposed side walls 52*a* and 52*b* each joined with opposed end walls 54*a* and 54*b*. The side and end walls 52*a-b*, 54*a-b* define a top opening 56 and a bottom opening 58 of the gate 12. Walls 52*a-b* and 54*a-b* have an upper edge 60 that is joined with a flange or upper surface 62 and a lower edge 61 adjacent opening 58. Flange 62 has a plurality of openings 64 that are aligned with openings in flange 30 for receiving fasteners 66 (FIG. 2) to join the adapter 10 to the gate 12. The dimensions of the flange 30 on adapter 10 may be varied depending on the type of hopper car gate 12 to which the adapter is mounted. As shown in FIG. 7, walls 52*a* and 52*b* are substantially parallel to walls 20*a* and 20*b*, and as shown in FIG. 9, walls 54*a* and 54*b* are substantially parallel to walls 22*a* and 22*b*.

Figure 6:
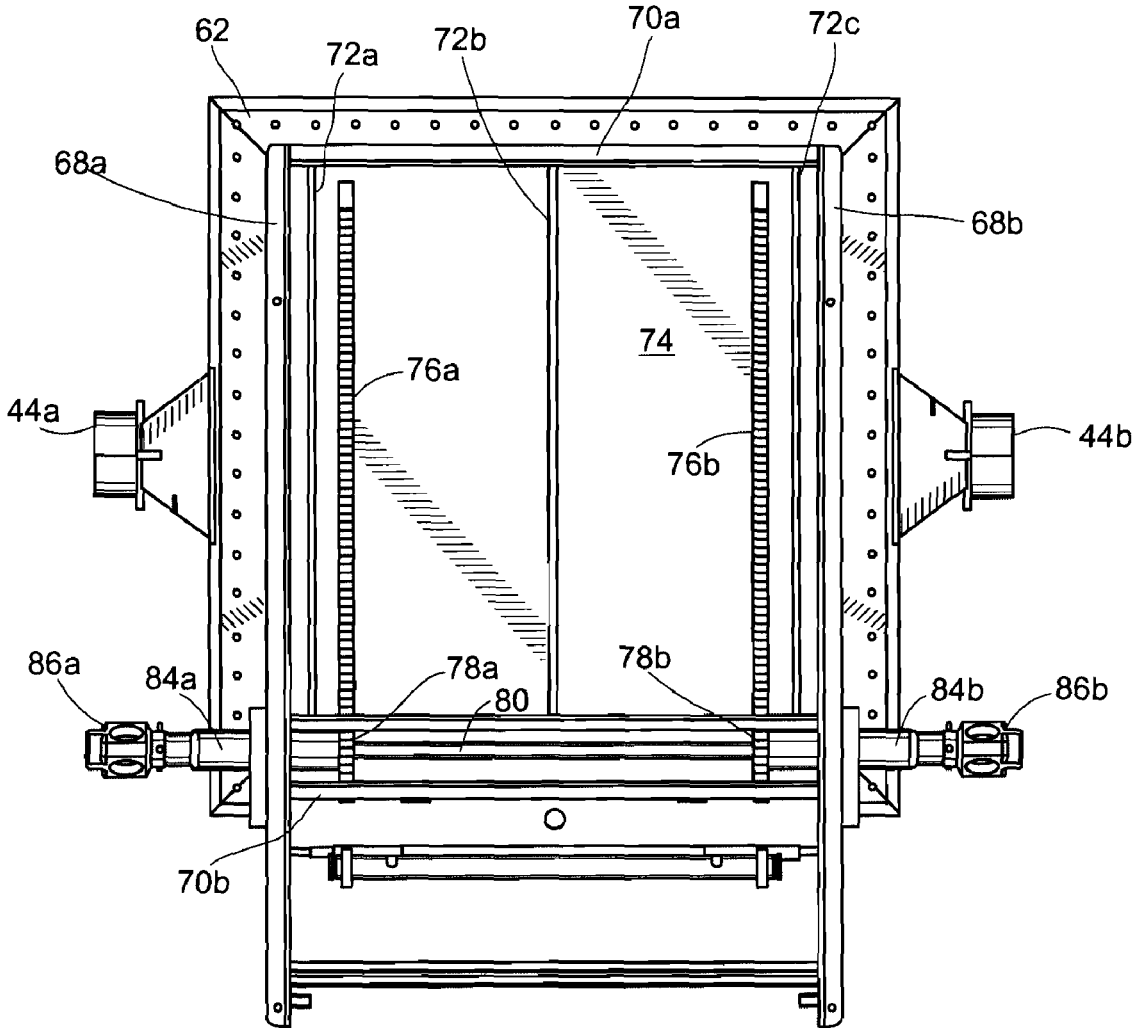
FIG. 6 is a bottom plan view of the adapter and gate shown in FIG. 1.

Walls 52*a* and 52*b* (FIG. 10) are joined with frame members 68*a* and 68*b*, respectively, and wall 54*a* is joined with frame member 70*a* (FIG. 6). Frame members 68*a* and 68*b* are joined with frame member 70*a*. Another frame member 70*b* (FIG. 6) is joined with frame members 68*a* and 68*b* underneath wall 54*b* (FIG. 10). Three rails 72*a*, 72*b*, and 72*c* (FIG. 6) extend between and are joined with frame members 70*a* and 70*b*. The rails 72*a*-72*c* support a door 74.

Door 74 is moveable between open and closed positions for allowing gravity discharge of material through the adapter 10 and gate 12. In the open position, door 74 allows cargo to exit through bottom opening 58 (FIG. 10) and in the closed position, door 74 blocks bottom opening 58. As shown in FIG. 6, two racks 76*a* and 76*b* are mounted to the bottom surface of door 74. The racks 76*a* and 76*b* engage pinions 78*a* and 78*b* mounted on a shaft 80. Shaft 80 rotates within and is supported by bearings 82*a* and 82*b* (FIG. 8) positioned within sleeves 84*a* and 84*b* that are joined to frame members 68*a* and 68*b*, respectively. Sockets 86*a* and 86*b* are joined to the outer ends of shaft 80 for engaging a tool to rotate shaft 80. As shaft 80 rotates, pinions 78*a* and 78*b* engage racks 76*a* and 76*b* to move door 74 in a direction that is perpendicular to shaft 80. A locking mechanism 88, shown in FIG. 1, is joined to and extends between frame members 68*a* and 68*b* for preventing unwanted motion of door 74.

Referring to FIG. 1, flange 26 has a plurality of holes 90 for receiving fasteners (not shown) to join the adapter 10 and gate 12 to a hopper car (not shown). Preferably, the hopper car has a plurality of hoppers for storing cargo. Each of the hoppers preferably has an opening at the bottom of the car and a rim surrounding the opening. The rim has a plurality of holes that align with the holes 90 in flange 26. The aligned holes receive fasteners for joining the adapter 10 to the rim of the hopper car. With the adapter 10 and gate 12 joined to a cargo containing hopper car, the cargo fills the volume defined by second set of walls 16 and door 74. The dimensions of flange 26 on adapter 10 may be varied depending on the type of hopper car to which the adapter 10 is mounted.

Referring to FIGS. 1 and 7, the lower edge 34 of the second set of walls 16 is spaced above door 74 when the door 74 is in the closed position to present a gap 92 between the lower edge 34 and door 74. The vertical height of gap 92, or the vertical distance between lower edge 34 and door 74, is approximately between 0 to 0.5 inches, and most preferably approximately 0.25 inches. It is also within the scope of the present invention for a seal or seals to be joined to the lower edge 34 of the second set of walls 16 between notches 36 in order to seal the gap 92 between lower edge 34 and door 74. As shown in FIG. 7, the bottom edges of the vacuum openings 42*a* and 42*b* are vertically spaced a distance H from the lower edge 34 and gap 92. The distance H is preferably between approximately 1 to 4 inches, and is preferably at least one inch. The distance H prevents cargo from entering the vacuum conduits 44*a* and 44*b* while the hopper car to which the adapter 10 and gate 12 are joined is traveling.

When door 74 is in its closed position, as shown in FIG. 1, a vacuum system joined to either or both of vacuum conduits 44*a* and 44*b* can draw the cargo that fills the volume between second set of walls 16 and door 74 through the notches 36 and the gap 92 into the vacuum chamber 46 between the first and second sets of walls 14 and 16. From the vacuum chamber 46, the vacuum system can draw the cargo through the vacuum openings 42*a* and 42*b* and vacuum conduits 44*a* and 44*b*. The dimensions and number of the notches 36 and the height of gap 92 may be varied depending on the type of cargo contained by the hopper car to which the adapter 10 is joined and the type and capacity of the vacuum system being used.

Referring to FIG. 7, the upper edge 60 of the walls 52*a-b* and 54*a-b* of frame 50 is aligned with the lower edge 28 of the first set of walls 14 when the adapter 10 and frame 50 are joined. Because walls 52*a-b* and 54*a-b* and walls 14 are aligned in this fashion when adapter 10 and frame 50 are joined, the walls 14, 52*a-b* and 54*a-b* function in combination as a set of walls having an upper section (first set of walls 14) and a lower section (walls 52*a-b* and 54*a-b*). The lower section (walls 52*a-b* and 54*a-b*) is positioned at an angle with respect to the upper section (first set of walls 14).

Figure 11:
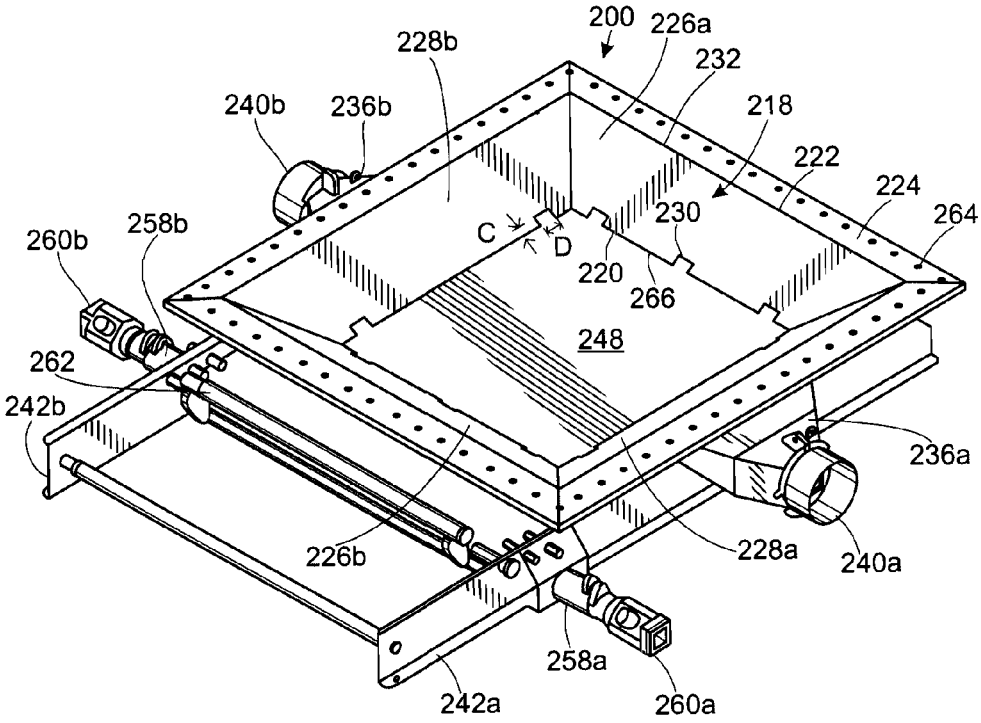
FIG. 11 is a perspective view of a hopper car gate according to another embodiment of the present invention.
Figure 12:
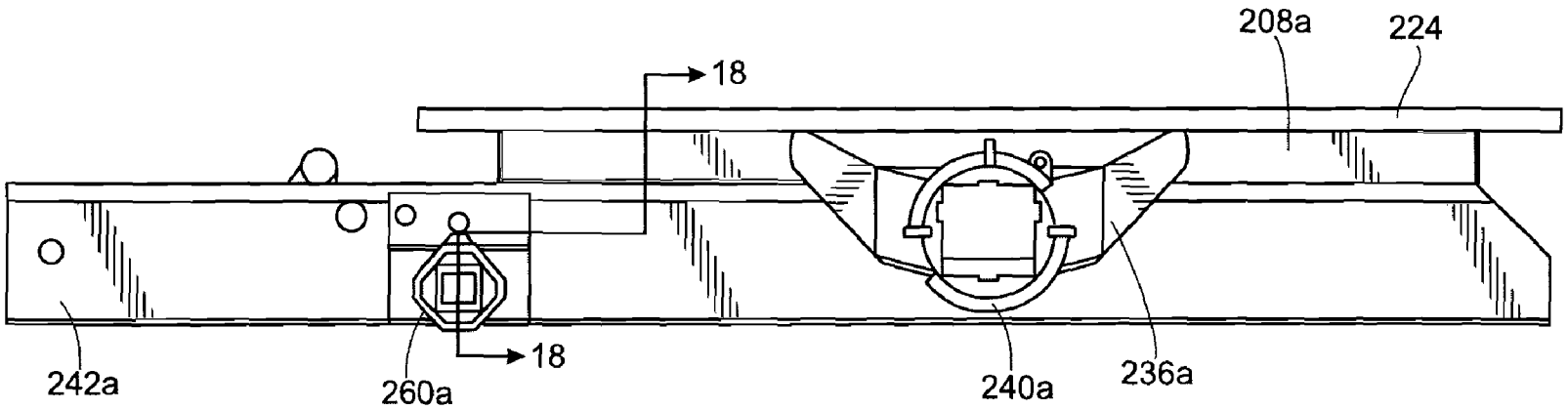
FIG. 12 is a side elevational view of the gate shown in FIG. 11.
Figure 13:
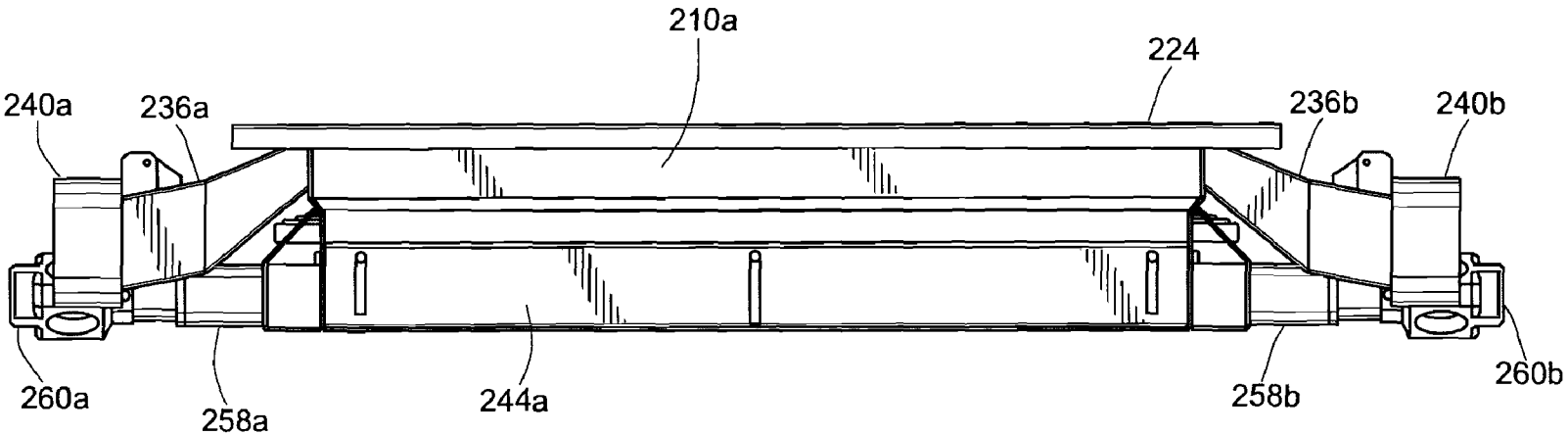
FIG. 13 is a front elevational view of the gate shown in FIG. 11.
Figure 14:
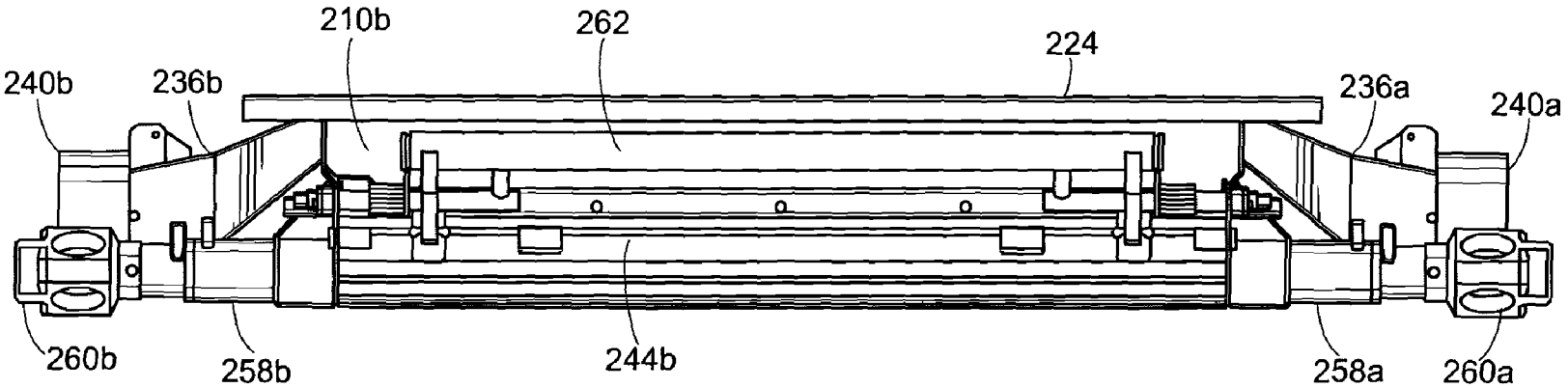
FIG. 14 is a rear elevational view of the gate shown in FIG. 11.
Figure 15:
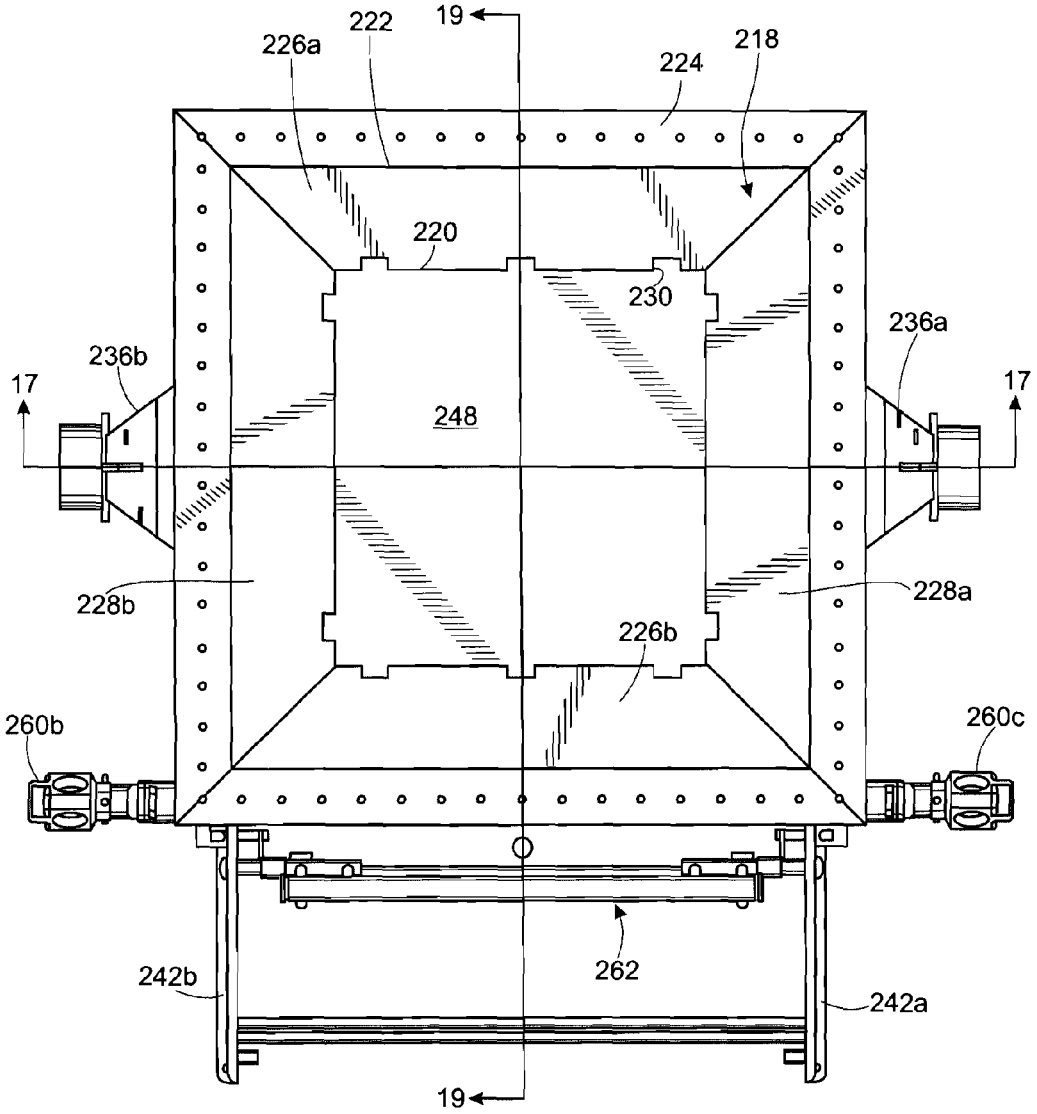
FIG. 15 is a top plan view of the gate shown in FIG. 11.

Referring now to FIG. 11, a hopper car gate according to another embodiment of the present invention is shown generally as 200. Hopper car gate 200 functions in substantially the same manner as the combination of adapter 10 and gate 12 shown in FIG. 1 and described above. While adapter 10 is a separate component that bolts to a gravity discharge hopper car gate 12 to provide the gate 12 with vacuum discharge capability, hopper car gate 200 is designed as a single unit that has both gravity and vacuum discharge capability.

Figure 19:
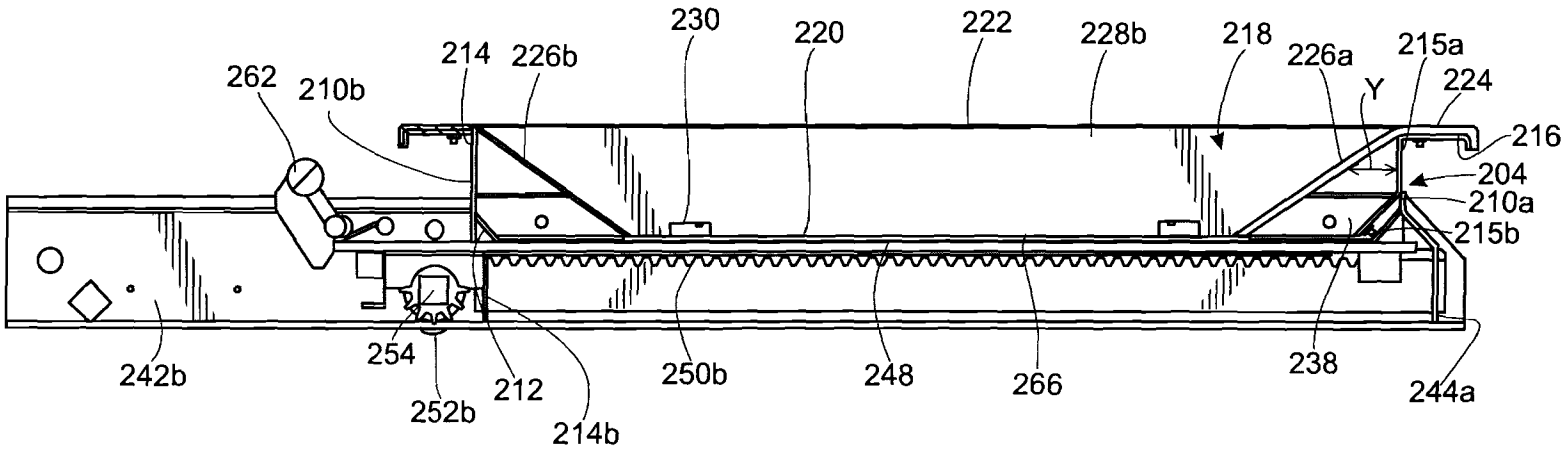
FIG. 19 is a cross-sectional view taken through the line 19-19 of FIG. 15.
Figure 20:
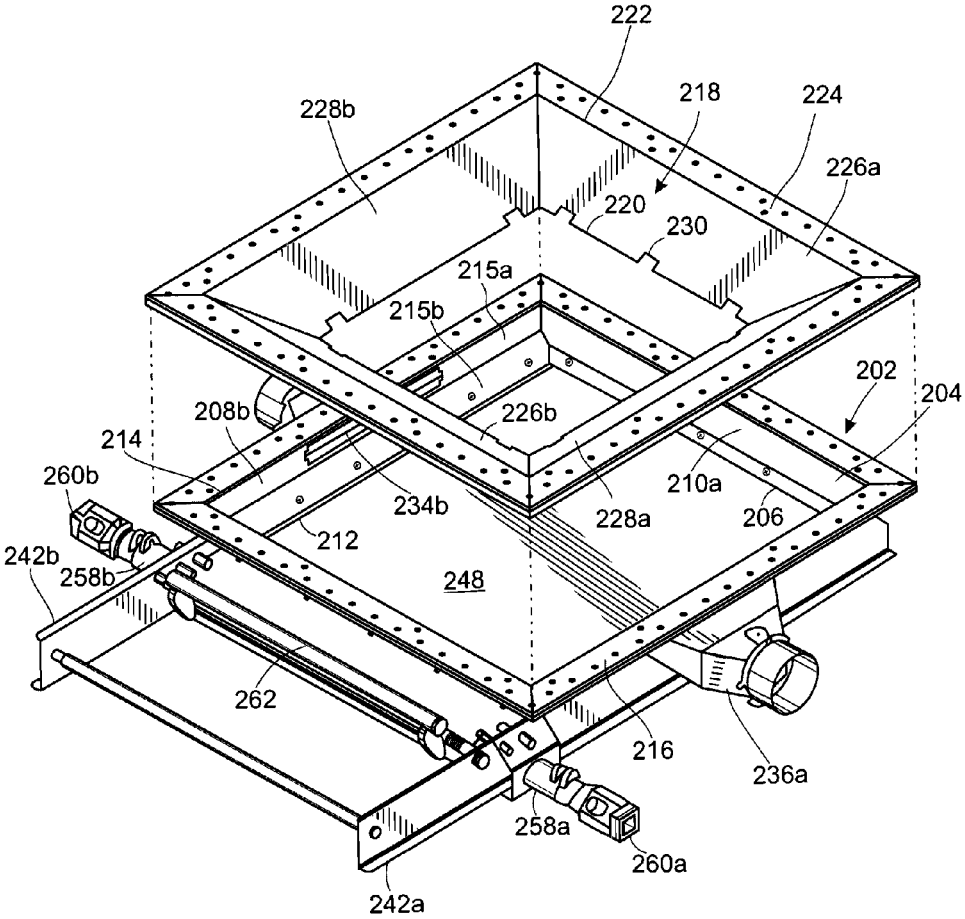
FIG. 20 is a partially exploded view of the gate shown in FIG. 11.

Referring to FIG. 20, hopper car gate 200 includes a frame 202 having a first set of walls 204 defining a discharge opening 206. The first set of walls 204 includes side walls 208*a* and 208*b*, shown in FIG. 17, that are each joined with end walls 210*a* and 210*b*, shown in FIG. 19. The first set of walls 204 has a lower edge 212 and an upper edge 214. The first set of walls 204 has an upper section 215*a* that is substantially vertical and a lower section 215*b* that is positioned at an angle with respect to the upper section 215*a*. A flange 216 is joined to the upper edge 214 of the first set of walls 204. A second set of walls 218 has a lower edge 220 and an upper edge 222 that is joined to a flange 224. Flange 224 on the second set of walls 218 is joined to the flange 216 on the first set of walls 204 preferably by fasteners received by aligned openings in the flanges. The second set of walls 218 includes end walls 226*a* and 226*b* that are each joined with side walls 228*a* and 228*b*. Referring to FIG. 19, there is an angle Y between the second set of walls 218 and the upper section 215*a* of the first set of walls 204. The angle Y is preferably between approximately 30 to 60 degrees.

A plurality of notches 230 are formed in the lower edge 220 of walls 218. As shown in FIG. 11, there are three notches in each of end walls 226*a* and 226*b* and two notches in each of side walls 228*a* and 228*b*. It is within the scope of the invention for there to be more or less notches 230 than those shown in FIG. 11. The notches 230 preferably have a height C of between approximately 0.5 to 3 inches, and a width D of between approximately 1 to 4 inches. The gate 200 has a top opening 232 defined by walls 218. The joined walls and flanges of gate 200 may be integrally joined or joined by a process such as welding.

Figure 17:
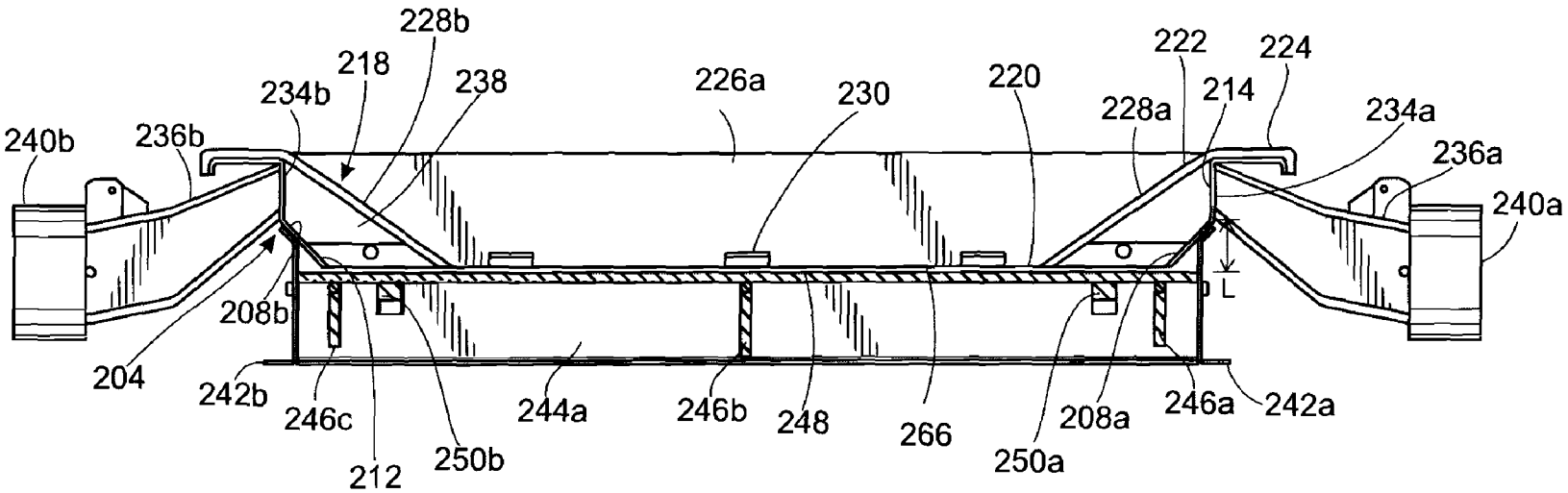
FIG. 17 is a cross-sectional view taken through the line 17-17 of FIG. 15.
Figure 18:
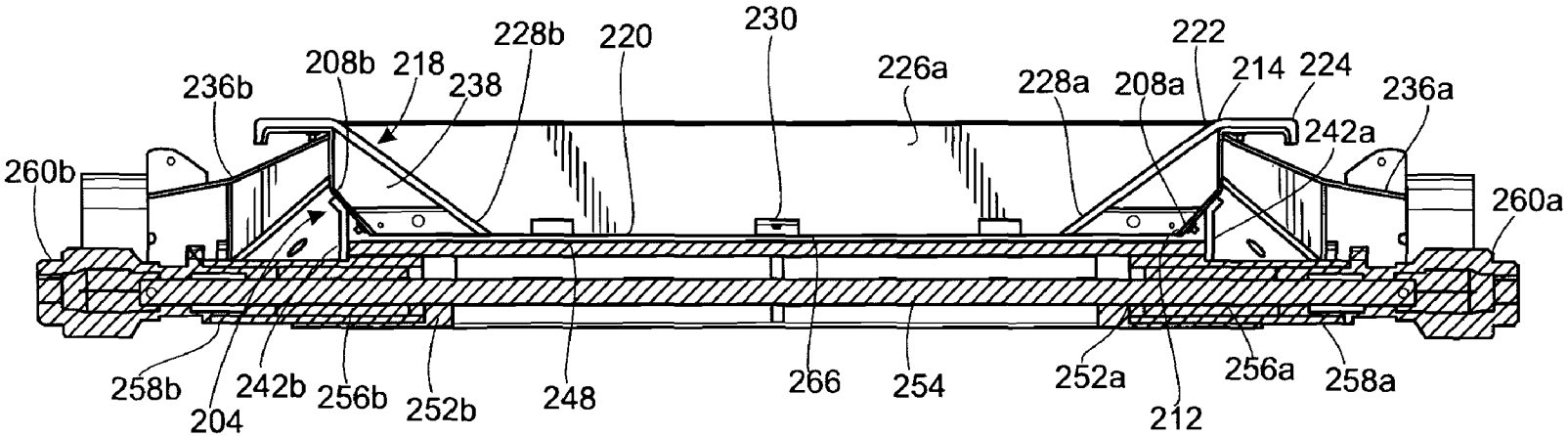
FIG. 18 is a cross-sectional view taken through the line 18-18 of FIG. 12.

As shown in FIG. 17, vacuum openings 234*a* and 234*b* are formed in side walls 208*a* and 208*b*, respectively. Vacuum conduits 236*a* and 236*b* are joined with and extend outward from side walls 208*a* and 208*b*, respectively. Vacuum conduits 236*a* and 236*b* are in fluid communication with vacuum openings 234*a* and 234*b*, respectively. The first and second sets of walls 204 and 218 are spaced from each other to define a vacuum chamber 238 (FIGS. 17-19) that is in fluid communication with each of the vacuum openings 234*a* and 234*b*. As shown in FIG. 11, each of the vacuum conduits 236*a* and 236*b* has a circular outer flange 240*a* and 240*b*, respectively, that is configured to engage a vacuum system for drawing material from the vacuum chamber 238 through the vacuum openings 234*a* and 234*b* and vacuum conduits 236*a* and 236*b*.

Figure 16:
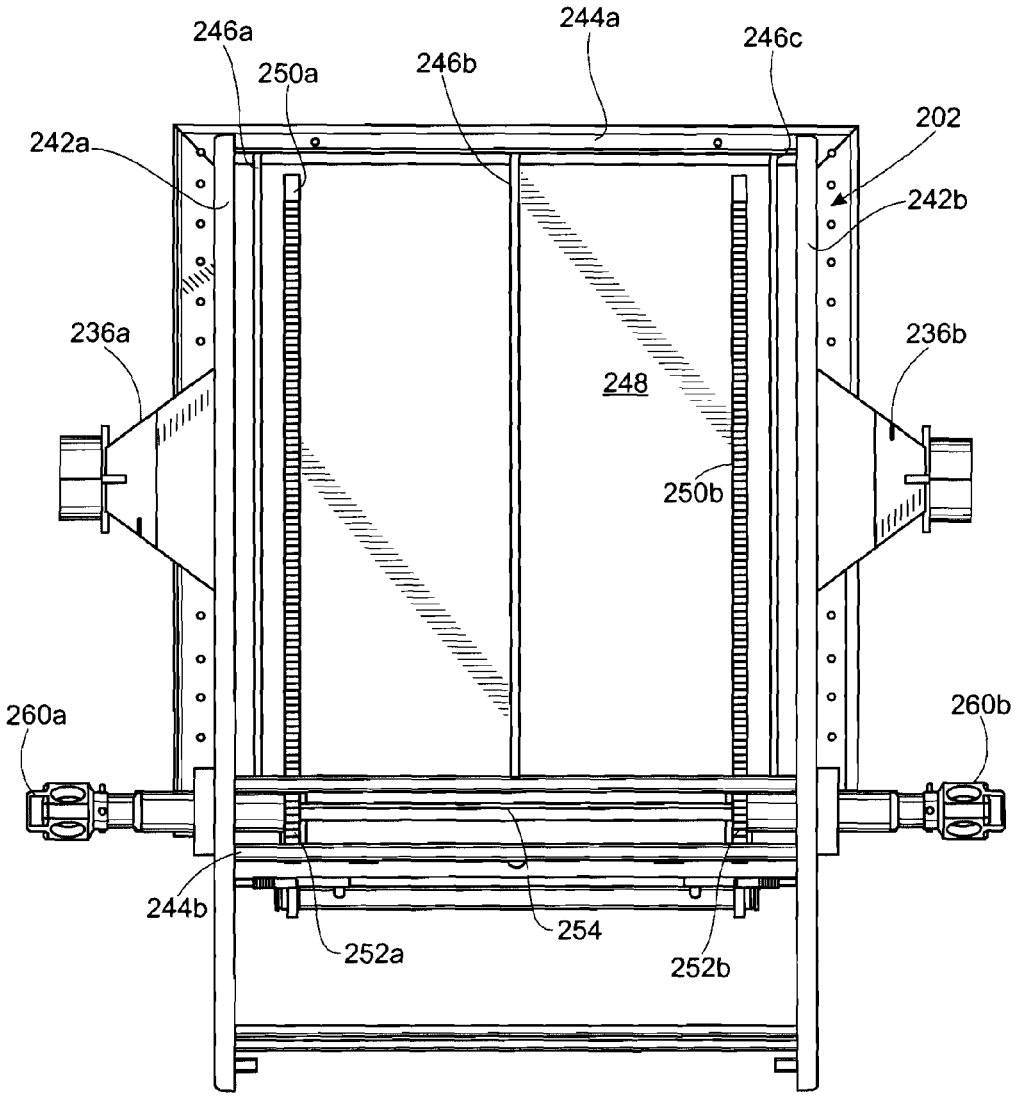
FIG. 16 is a bottom plan view of the gate shown in FIG. 11.

Referring to FIG. 16, the frame 202 includes frame members 242*a* and 242*b* that are joined with walls 208*a* and 208*b* (FIG. 17), respectively, and a frame member 244*a* that is joined with wall 210*a* (FIG. 20). Frame members 242*a* and 242*b* are joined with frame member 244*a*. Another frame member 244*b* is joined with frame members 242*a* and 242*b* underneath wall 210*b*. Three rails 246*a*, 246*b*, and 246*c* extend between and are joined with frame members 244*a* and 244*b*. The rails 246*a*-246*c* support a door 248.

Door 248 is moveable between open and closed positions for allowing gravity discharge of material through gate 200. In the open position, door 248 allows cargo to exit through bottom discharge opening 206 (FIG. 20) and in the closed position, door 248 blocks bottom discharge opening 206. As shown in FIG. 16, two racks 250*a* and 250*b* are mounted to the bottom surface of door 248. The racks 250*a* and 250*b* engage pinions 252*a* and 252*b* mounted on a shaft 254. Shaft 254 rotates within and is supported by bearings 256*a* and 256*b* (FIG. 18) positioned within sleeves 258*a* and 258*b* that are joined to frame members 242*a* and 242*b*, respectively. Sockets 260*a* and 260*b* are joined to the outer ends of shaft 254 for engaging a tool to rotate shaft 254. As shaft 254 rotates, pinions 252*a* and 252*b* engage racks 250*a* and 250*b* to move door 248 in a direction that is perpendicular to shaft 254. A locking mechanism 262, shown in FIG. 11, is joined to and extends between frame members 242*a* and 242*b* for preventing unwanted motion of door 248.

Referring to FIG. 11, flange 224 has a plurality of holes 264 for receiving fasteners (not shown) to join the gate 200 to a hopper car (not shown). Preferably, the hopper car has a plurality of hoppers for storing cargo. Each of the hoppers preferably has an opening at the bottom of the car and a rim surrounding the opening. The rim has a plurality of holes that align with the holes 264 in flange 224. The aligned holes receive fasteners for joining the gate 200 to the rim of the hopper car. With the gate 200 joined to a cargo containing hopper car, the cargo fills the volume defined by second set of walls 218 and door 248. The dimensions of flange 224 may be varied depending on the type of hopper car to which the gate 200 is mounted.

Referring to FIGS. 11 and 17, the lower edge 220 of the second set of walls 218 is spaced above door 248 when the door 248 is in the closed position to present a gap 266 between the lower edge 220 and door 248. The vertical height of gap 266, or the vertical distance between lower edge 220 and door 248, is approximately 0 to 0.5 inches, and most preferably approximately 0.25 inches. It is also within the scope of the present invention for a seal or seals to be joined to the lower edge 220 of the second set of walls 218 between notches 230 in order to seal the gap 266 between lower edge 220 and door 248. As shown in FIG. 17, the bottom edges of the vacuum openings 234*a* and 234*b* are vertically spaced a distance L from the lower edge 220 and gap 266. The distance L is preferably between approximately 1 to 4 inches, and is preferably at least one inch. The distance L prevents cargo from entering the vacuum conduits 236*a* and 236*b* while the hopper car to which the gate 200 is joined is traveling.

When door 248 is in its closed position, as shown in FIG. 11, a vacuum system joined to either or both of vacuum conduits 236*a* and 236*b* can draw the cargo that fills the volume between second set of walls 218 and door 248 through the notches 230 and the gap 266 into the vacuum chamber 238 between the first and second sets of walls 204 and 218. From the vacuum chamber 238, the vacuum system can draw the cargo through the vacuum openings 234*a* and 234*b* and vacuum conduits 236*a* and 236*b*. The dimensions and number of the notches 230 and the height of gap 266 may be varied depending on the type of cargo contained by the hopper car to which the gate 200 is joined and the type and capacity of the vacuum system being used.

In operation, the adapter 10, shown in FIGS. 1-10, is first joined to gate 12 by aligning flange 30 (FIG. 10) on adapter 10 with flange 62 on gate 12 and inserting fasteners through the aligned holes of the flanges 30 and 62. Then, the flange 26 on adapter 10 is mounted to the rim surrounding a hopper discharge opening of a hopper car by inserting fasteners through aligned openings on the flange 26 and hopper rim. With the door 74 in its closed position, the hopper is filled with cargo. When the hopper car reaches its final destination, the cargo can be discharged through the adapter 10 and gate 12 by either vacuum or gravity discharge. To discharge the cargo through the adapter 10 and gate 12 by vacuum discharge, a vacuum system is coupled with one or both of the flanges 48*a* and 48*b* of vacuum conduits 44*a* and 44*b*. The vacuum system is powered on to draw cargo from the hopper through notches 36 and gap 92 into vacuum chamber 46 (FIG. 7). From vacuum chamber 46, the vacuum system draws the cargo through vacuum openings 42*a* and 42*b* and vacuum conduits 44*a* and 44*b*.

For gravity discharge of material through adapter 10 and gate 12, door 74 is moved from its closed position to its open position by engaging one of sockets 86*a* and 86*b* with an opening tool and rotating the socket 86*a*, 86*b*. Rotation of one of sockets 86*a* and 86*b* causes shaft 80 and pinions 78*a* and 78*b* to rotate. As the pinions 78*a* and 78*b* rotate they engage racks 76*a* and 76*b* on the bottom of door 74 and cause the door 74 to move to its open position. With the door 74 in its open position, cargo contained within the hopper to which the adapter 10 and gate 12 are joined discharges through the bottom opening 58 (FIG. 10) of the gate 12.

Gate 200, shown in FIGS. 11-20, operates in a similar fashion as the combination of adapter 10 and gate 12. First, the flange 224 on gate 200 is mounted to the rim surrounding a hopper discharge opening of a hopper car by inserting fasteners through aligned openings on the flange 224 and hopper rim. With the door 248 in its closed position, the hopper is filled with cargo. When the hopper car reaches its final destination, the cargo can be discharged through the gate 200 by either vacuum or gravity discharge. To discharge the cargo through gate 200 by vacuum discharge, a vacuum system is coupled with one or both of the flanges 240*a* and 240*b* of vacuum conduits 236*a* and 236*b*. The vacuum system is powered on to draw cargo from the hopper through notches 230 and gap 266 into vacuum chamber 238 (FIG. 17). From vacuum chamber 238, the vacuum system draws the cargo through vacuum openings 234*a* and 234*b* and vacuum conduits 236*a* and 236*b*.

For gravity discharge of material through gate 200, door 248 is moved from its closed position to its open position by engaging one of sockets 260*a* and 260*b* with an opening tool and rotating the socket 260*a*, 260*b*. Rotation of one of sockets 260*a* and 260*b* causes shaft 254 and pinions 252*a* and 252*b* to rotate. As the pinions 252*a* and 252*b* rotate they engage racks 250*a* and 250*b* on the bottom of door 248 and cause the door 248 to move to its open position. With the door 248 in its open position, cargo contained within the hopper to which the gate 200 is joined discharges through the discharge opening 206 (FIG. 20) of the gate 200.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hopper car gate for discharging cargo from a hopper car, said car comprising a hopper having an opening and a rim surrounding said opening, comprising:

a first set of walls comprising opposed side walls coupled with opposed end walls, wherein at least one vacuum opening is formed in one of said side or end walls, said first set of walls presenting top and bottom openings;

a rail extending between and coupled with said side or end walls adjacent said bottom opening;

a door supported on said rail and moveable between a closed position in which it blocks said bottom opening and an open position in which it allows cargo to exit through said bottom opening; and a second set of walls comprising opposed side walls coupled with opposed end walls, said second set of walls comprising an upper edge and a lower edge that is at least partially spaced above said door when said door is in its closed position to present a gap between said lower edge and said door, said second set of walls coupled with said first set of walls to present a vacuum chamber positioned between said first and second sets of walls, said vacuum chamber in fluid communication with said vacuum opening.

2. The gate of claim 1, wherein said first set of walls comprises an upper edge adjacent to said top opening that is coupled with said upper edge of said second set of walls.

3. The gate of claim 2, wherein said second set of walls are positioned at an angle with respect to said first set of walls.

4. The gate of claim 3, wherein the angle between said first and second sets of walls is between approximately 30 to 60 degrees.

5. The gate of claim 2, further comprising a flange coupled with said upper edge of said first set of walls, said flange adapted to be joined to the rim of the car.

6. The gate of claim 1, wherein said vacuum opening is positioned at least one inch above said gap.

7. The gate of claim 1, further comprising a vacuum conduit in fluid communication with said vacuum opening, said conduit coupled with and extending from one of said side or end walls, said vacuum conduit operable to be engaged by a vacuum system for drawing cargo through said gap, said vacuum chamber, and said vacuum opening into said vacuum conduit when said door is in its closed position.

8. The gate of claim 1, wherein said gap has a height of between approximately 0 to 0.5 inches.

9. The gate of claim 1, wherein notches are formed in said lower edge of said second set of walls.

10. The gate of claim 1, wherein said first set of walls comprises upper and lower sections, each of which having upper and lower edges, and further comprising:

first and second mating flanges, said first flange coupled with said upper edge of said lower section and said second flange coupled with said lower edge of said upper section; and a third flange coupled with said upper edge of said upper section and with said upper edge of said second set of walls, said third flange adapted to be joined to the rim of the car.

11. The gate of claim 10, wherein said vacuum opening is formed in said upper section of said first set of walls.

12. The gate of claim 10, wherein said second set of walls and said lower section are positioned at an angle with respect to said upper section.

13. A vacuum adapter configured for mounting on a hopper car gate comprising a frame presenting a top opening, a bottom opening, and an upper surface surrounding said top opening; and a door supported by said frame and moveable between a closed position in which it blocks said bottom opening and an open position in which it allows cargo to exit through said bottom opening for discharging cargo from a hopper car, said adapter comprising:

a flange configured for mounting to said upper surface;

a first set of walls comprising upper and lower edges, said lower edge coupled with said flange, wherein at least one vacuum opening is formed in said first set of walls; and a second set of walls comprising an upper edge coupled with said upper edge of said first set of walls and a lower edge that is at least partially spaced above said door when said door is in its closed position to present a gap between said lower edge and said door, wherein said second set of walls is positioned to define a vacuum chamber between said first and second sets of walls and said frame, said vacuum chamber in fluid communication with said vacuum opening.

14. The vacuum adapter of claim 13, further comprising another flange coupled with said upper edge of said first set of walls, said other flange configured for mounting to a hopper car.

15. The vacuum adapter of claim 13, wherein said second set of walls are positioned at an angle with respect to said first set of walls.

16. The vacuum adapter of claim 13, wherein said vacuum opening is positioned at least one inch above said gap.

17. The vacuum adapter of claim 13, further comprising a vacuum conduit in fluid communication with said vacuum opening, said conduit coupled with and extending from said first set of walls, said vacuum conduit operable to be engaged by a vacuum system for drawing cargo through said gap, said vacuum chamber, and said vacuum opening into said vacuum conduit when said door is in its closed position.

18. The vacuum adapter of claim 13, wherein said gap has a height of between approximately 0 to 0.5 inches.

19. The vacuum adapter of claim 13, wherein notches are formed in said lower edge of said second set of walls.

20. A hopper car gate, comprising:

a frame defining a discharge opening;

a door supported by said frame and moveable between a closed position in which it blocks said discharge opening and an open position in which it allows cargo to exit through said discharge opening; and a set of walls comprising an upper edge coupled with an upper edge of said frame and a lower edge that is at least partially spaced above said door when said door is in its closed position to present a gap between said lower edge and said door, said set of walls being positioned to define a vacuum chamber between said set of walls and said frame, said vacuum chamber in fluid communication with a vacuum opening formed in said frame, and wherein said gap is in fluid communication with said vacuum chamber and said vacuum opening.

21. The gate of claim 20, wherein said frame comprises opposed side walls coupled with opposed end walls and a flange that is adapted to be joined to a hopper car.

22. The gate of claim 20, wherein said frame comprises a rail which supports said door.

23. The gate of claim 20, wherein said frame comprises upper and lower sections, each of which having upper and lower edges, and further comprising:

first and second mating flanges, said first flange coupled with said upper edge of said lower section and said second flange coupled with said lower edge of said upper section; and a third flange coupled with said upper edge of said upper section and with said upper edge of said set of walls, said third flange adapted to be joined to a hopper car.

24. The gate of claim 23, wherein said vacuum opening is formed in said upper section of said frame.

25. The gate of claim 23, wherein said set of walls and said lower section are positioned at an angle with respect to said upper section.

* * * * *